US007406809B2

(12) United States Patent
Spatafora et al.

(10) Patent No.: US 7,406,809 B2
(45) Date of Patent: Aug. 5, 2008

(54) METHOD AND A DEVICE FOR CHECKING WRAPPING MATERIAL IN A PACKAGING MACHINE

(75) Inventors: Mario Spatafora, Bologna (IT); Bruno Tommasini, Bologna (IT)

(73) Assignee: G.D S.p.A., Bologna (IT)

( * ) Notice: Subject to any disclaimer, the term of this patent is extended or adjusted under 35 U.S.C. 154(b) by 0 days.

(21) Appl. No.: 10/467,468

(22) PCT Filed: Nov. 19, 2001

(86) PCT No.: PCT/IB01/02178

§ 371 (c)(1),
(2), (4) Date: Aug. 8, 2003

(87) PCT Pub. No.: WO02/064470

PCT Pub. Date: Aug. 22, 2002

(65) Prior Publication Data

US 2004/0072664 A1 Apr. 15, 2004

(30) Foreign Application Priority Data

Feb. 14, 2001 (IT) ..... BO2001A0079

(51) Int. Cl.
*B65B 1/30* (2006.01)
*B26D 7/27* (2006.01)
*B65B 61/26* (2006.01)

(52) U.S. Cl. ..... 53/396

(58) Field of Classification Search ..... 53/466, 53/586, 268, 396, 505, 65, 129.1, 131.5, 53/135.3, 52
See application file for complete search history.

(56) References Cited

U.S. PATENT DOCUMENTS

| | | | | |
|---|---|---|---|---|
| 3,730,753 | A * | 5/1973 | Kerr | 430/30 |
| 3,768,227 | A * | 10/1973 | Grisell | 53/449 |
| 3,841,057 | A * | 10/1974 | Engeler | 53/389.3 |
| 4,590,747 | A * | 5/1986 | Schjeldahl | 53/562 |
| 4,786,353 | A * | 11/1988 | Templeton et al. | 156/359 |
| 4,887,532 | A | 12/1989 | Kotterer | |
| 5,056,646 | A * | 10/1991 | Kisler | 198/341.07 |
| 5,444,964 | A * | 8/1995 | Hanagata | 53/550 |
| 6,207,925 | B1 * | 3/2001 | Kendall | 219/121.63 |
| 6,357,201 | B1 * | 3/2002 | Focke et al. | 53/167 |

FOREIGN PATENT DOCUMENTS

EP 0666509 8/1995

* cited by examiner

*Primary Examiner*—Rinaldi I. Rada
*Assistant Examiner*—John Paradiso
(74) *Attorney, Agent, or Firm*—Timothy J. Klima

(57) ABSTRACT

Wrapping material (2) supplied to a packaging machine is caused to advance along a predetermined feed path (3) through a first checking station (27*a*) where an emitter device (29) charges at least one predetermined portion (30, 34) of the wrapping material (2) electrostatically, and a second checking station (27*b*) where a sensor (31) detects the presence of the electrostatic charges applied previously to the predetermined portion (30, 34) of the material (2). The sensor (31) is positioned along the feed path (3) downstream of and at a predetermined distance from the emitter device (29).

39 Claims, 7 Drawing Sheets

METHOD AND A DEVICE FOR CHECKING WRAPPING MATERIAL IN A PACKAGING MACHINE

This application is the National Phase of International Application PCT/IB01/02178 filed Nov. 19, 2001 which designated the U.S. and that International Application was published under PCT Article 21(2) in English.

TECHNICAL FIELD

The present invention relates to a method for checking wrapping material in a packaging machine.

In particular, the present invention relates to wrapping material decoiled from a respective roll and directed toward a user station in the form of a continuous strip, or of discrete lengths separated from the strip previously at a cutting station, or partially or wholly enveloping respective products to be wrapped at the aforementioned user station.

In addition, the present invention relates to wrapping material comprising at least two component materials, for example two continuous strips decoiled from respective rolls and then bonded together, or one continuous strip decoiled from a roll and a series of discrete lengths cut previously and then united with the continuous strip.

The two part wrapping material likewise is directed toward the aforementioned user station.

Upstream of the user station, depending on the type of material employed and on the particular packaging requirements, the two components can be jointed one to another at a jointing station.

BACKGROUND ART

It is conventional practice in the art field of packaging machines to employ a pneumatic flow compensating chamber, positioned along the feed path followed by the strip of wrapping material, of which the function is to absorb imbalances that can be created between the quantity of strip decoiled per unit of time from the respective roll, and the quantity of strip taken up in the same unit of time by the user station. Such flow compensating chambers are furnished with respective suction means capable of attracting the strip with a predetermined and constant force so that it is retained internally of the chamber as a running loop of variable length; in this way, the strip material can be maintained substantially at a constant tension as it is directed toward the user station, and the loop constitutes a reserve such as will compensate variations in the rate at which the strip is taken up by the user station.

In particular, the rate at which the strip decoils will be governed according to the length of the loop that is allowed to form progressively inside the flow compensating chamber; for example, an increase in the length of the loop means that the decoil rate is higher than the rate at which the strip is taken up by the user station, and accordingly, an adjustment must be made to the drive means controlling the rate of decoil from the roll.

The feed rate of the strip is also monitored directly along the path followed by the strip upstream of the cutting station, or alternatively downstream of the cutting station, in order to control the positioning of the discrete lengths generated by the cutting operation, also their timing relative to a user station lying downstream of the cutting station, and relative to the cutting station itself.

More particularly, in the case of materials comprising at least two component parts, consisting for example in two identical strips, or in a strip of clear and colourless plastic material and a ribbon of slender transverse dimensions decoiled from a roll and supplied as a continuous strip or in discrete lengths, embodied in the same type of material as the strip to which it will be bonded, it becomes necessary to verify the presence and/or the correct mutual positioning of the two component parts.

In prior art systems such checking functions are generally entrusted, by way of example, to optical or capacitive or inductive devices. These devices are not always reliable inasmuch as their performance characteristics can be rendered false in the case of transparent material, or may vary with the colour of the wrapping material, and can also be disturbed by layers of residual matter and dust deposited on the strip and on the devices themselves as the strip advances. It is also possible to use barrier photocells operating in the visible or the infrared spectrum, or a thickness check can be employed. These further methods allow only tight calibration margins, with the result that the system can be affected by instability.

DISCLOSURE OF THE INVENTION

The object of the present invention is to provide a method of checking wrapping material that will ensure reliability and precision, and be unaffected by the above noted drawbacks.

The stated object is realized in a method according to the present invention for checking wrapping material in a packaging machine, wherein the wrapping material is supplied to the packaging machine, characterized in that it comprises at least the steps of electrostatically charging at least one predetermined portion of the wrapping material at a point coinciding with at least one first operative checking station, and of detecting the presence of electrostatic charges on the predetermined portion of the wrapping material at a point coinciding with at least one second operative checking station.

The present invention relates also to a device for checking wrapping material in a packaging machine.

A device according to the invention for checking wrapping material in a packaging machine, wherein the wrapping material is supplied to the packaging machine, is characterized in that it comprises electrostatic charge emitter means able to charge at least one predetermined portion of the wrapping material electrostatically at a point coinciding with at least one first operative checking station, and sensing means able to detect the presence of electrostatic charges on the predetermined portion of the wrapping material at a point coinciding with at least one second operative checking station.

BRIEF DESCRIPTION OF THE DRAWINGS

The invention will now be described in detail, by way of example, with the aid of the accompanying drawings, in which.

DETAILED DESCRIPTION OF THE PREFERRED EMBODIMENT OF THE INVENTION

Figure 1:
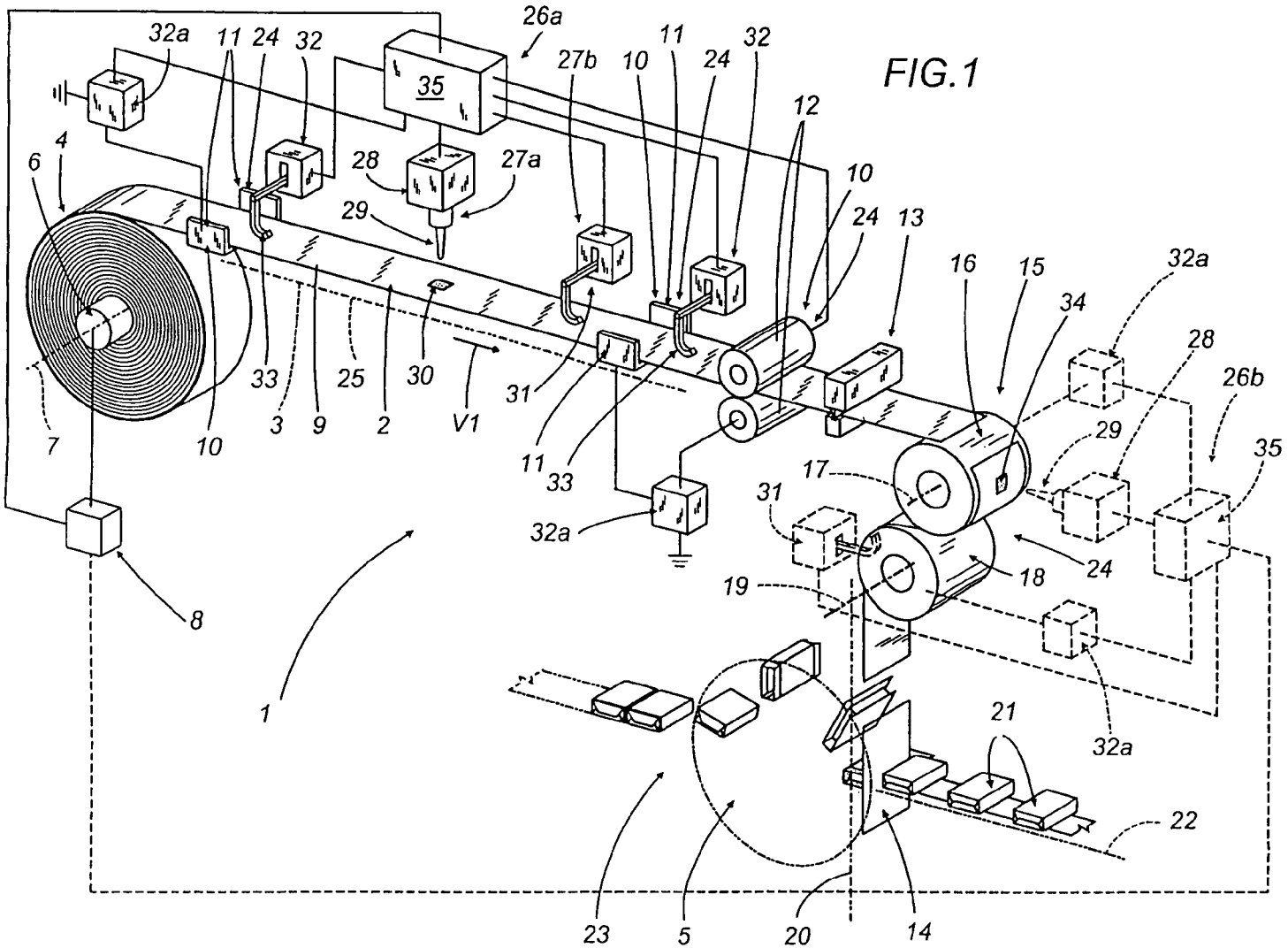
FIG. 1 illustrates a portion of a packaging machine comprising the checking device according to the present invention, shown in two embodiments, viewed schematically and in perspective with certain parts omitted.
Figure 2:
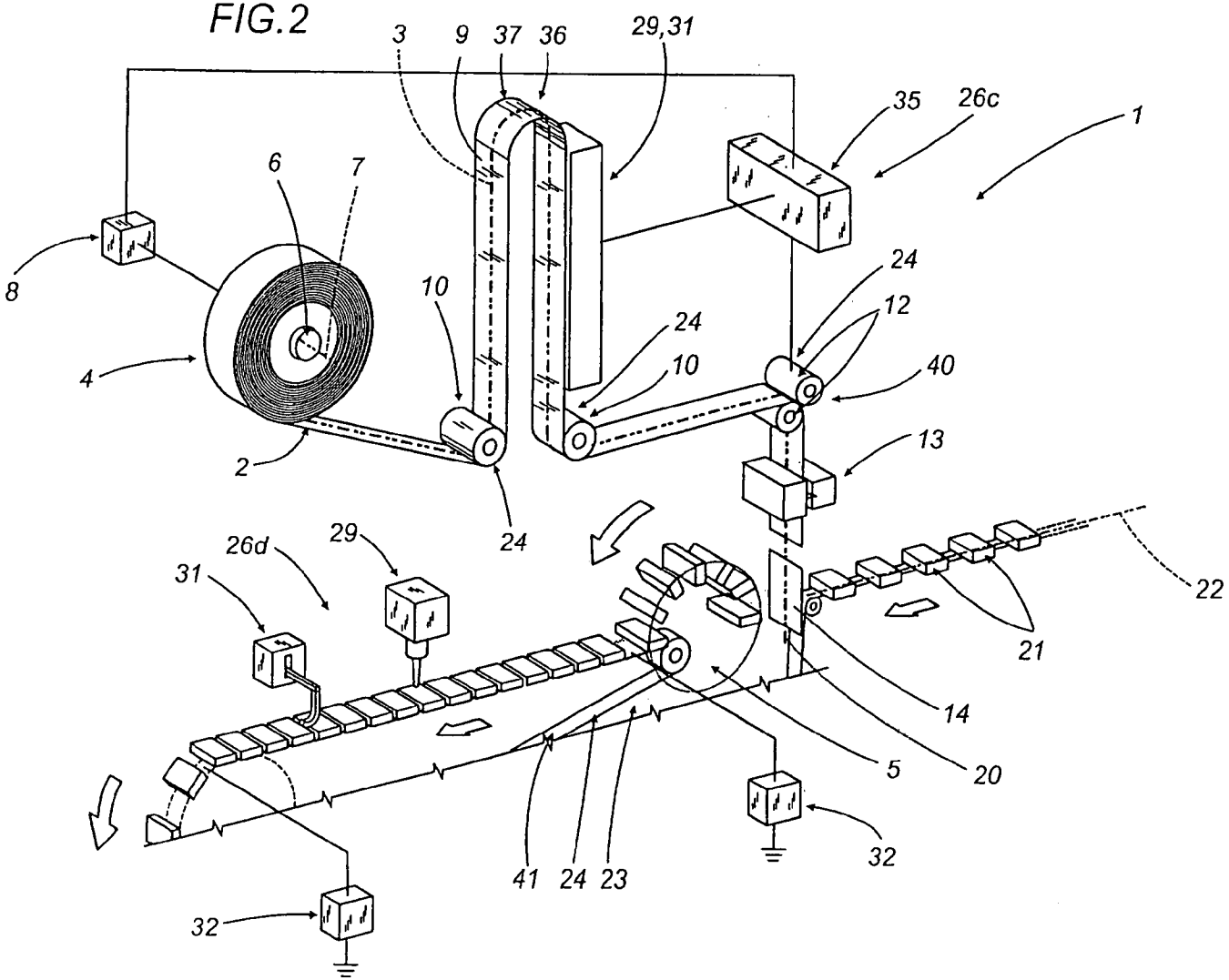
FIG. 2 illustrates a portion of a packaging machine comprising the checking device shown in an alternative embodiment, viewed schematically and in perspective with certain parts omitted.

With reference to FIGS. 1 and 2 of the drawings, 1 denotes a portion of an automatic packaging machine, in its entirety, in which a wrapping material 2 consisting in a single component C1, appearing as a continuous strip 9, is advanced along a feed path 3 extending from a decoiling roll 4 toward a user station 5.

As illustrated in FIG. 1, the roll 4 is mounted to a pivot 6 with a horizontally disposed axis 7, driven by a respective motor 8 such as will decoil the continuous strip 9 and cause it to advance through guiding and pulling devices 10, illustrated schematically and by way of example as an assembly of guides 11 and pinch rolls 12 arranged along the feed path 3, toward a cutter device 13 by which it is separated into discrete lengths, or sheets 14.

The sheets 14 are directed seriatim onto a take-up and feed unit 15 which in the example illustrated comprises a first roller 16 with a horizontally disposed axis 17 by which the sheets 14 are taken up and distanced one from another and from the strip 9, and a second roller 18, of which the axis 19 extends parallel to the first axis 17, operating in conjunction with the first roller 16 in such a way as to direct the sheets 14 along a vertical leg 20 of the feed path 3 toward the user station 5.

The single sheet 14 is intercepted at the user station 5 by a product 21 advancing along a second feed path 22 extending transversely to the vertical leg 20 of the first path 3. Each sheet 14 is united thus with a respective product 21, which it proceeds to envelop as the two are advanced along a wrapping line 23 that extends along the second feed path 22.

In particular, the guiding and pulling devices 10 and the take-up and feed unit 15 together constitute means, denoted 24 in their entirety, by which to convey the wrapping material 2.

Also illustrated in FIG. 1, positioned along a first horizontal leg 25 of the feed path 3 compassed by the guides 11 and the pinch rolls 12, is a unit denoted 26*a* in its entirety for checking the wrapping material 2, of which a first embodiment is indicated in unbroken lines. Departing from the roll 4 and in an area occupied by a first operative station 27*a*, the unit 26*a* comprises an electrostatic charge generator 28 of which the relative emitter device 29 is directed at the strip 9 in such a way that a predetermined portion 30 of the selfsame strip 9, advancing at a velocity denoted V1, is invested with a flow of electrostatic charges and thus charged electrostatically. In particular, the strip 9 is made of an electrically insulating material, or in any event the face of the strip offered to the emitter device 29 has electrically insulating properties.

Located beyond the emitter device 29 in the downstream direction and in the area occupied by a second operative station 27*b*, at a given distance from the emitter device 29, the unit 26*a* comprises a sensor 31 capable of detecting electrostatic charges applied previously to the predetermined portions 30 of the strip 9. The checker unit 26*a* can also comprise discharger devices 32 which, in the embodiment of FIG. 1 illustrated with unbroken lines, comprise first and second sliding contacts 33 positioned respectively upstream of the emitter device 29 and downstream of the sensor 31. The two sliding contacts 33 are capable of movement between a position of no contact or disengagement relative to the strip 9, and a position of contact with the selfsame strip 9 (indicated in FIG. 1) in which they are able to rid the strip 9 of any leaked electrostatic charges and thus protect the strip 9, ensuring that such charges as may be attributable to leakage will not impact negatively on the checking function. Moreover, the dischargers 32 in question can also be used to neutralize the strip 9 completely should it be expedient to suspend or terminate the checking function.

Observing the discharger 32 positioned downstream of the sensor 31, it will be evident that there could be advantages in eliminating all traces of static electricity from the wrapping material 2 before further operations of whatever nature are carried out on the selfsame material.

As discernible from FIG. 1, the dischargers 32 in question might also be associated both with the guides 11 and with the rolls 12, in order to protect the strip 9 from electrostatic charges that may have leaked to the relative guiding and pulling device 10, and might consist in earth contacts 32*a*.

A second embodiment, illustrated with phantom lines in FIG. 1, includes a checker unit 26*b* positioned to coincide with the take-up and feed unit 15. The unit 26*b* comprises a respective electrostatic charge generator 28 of which the relative emitter device 29 is directed at the first roller 16 in such a way as to apply an electrostatic charge to a predetermined portion 34 of each successive sheet 14, also a respective sensor 31 positioned in alignment with the second roller 18 and capable of detecting electrostatic charges applied previously to the aforementioned predetermined portions 34. In like manner to the embodiment first described, the two rollers 16 and 18 form part of conveying means 24 by which the wrapping material 2 is advanced along the feed path, and can be equipped similarly with respective discharger contacts 32*a* serving to connect the rollers 16 and 18 to earth.

In operation, with reference to FIG. 1 and to the unit 26*a* first mentioned, the continuous strip 9 is caused to advance at the predetermined velocity V1 and the emitter device 29 proceeds to charge the predetermined portions 30 electrostatically at a predetermined frequency, whilst the sensor 31 detects the charges thus applied to the strip 9. The operations of timing the delivery of charges from the emitter device 29 and measuring the signal received from the sensor 31 are governed by a master controller 35. The distance between the emitter 29 and the sensor 31 being a known quantity, the rate at which the strip advances is monitored continuously and in the event of any drift from the predetermined velocity V1, the master controller 35 will relay a correction signal to the drive means 8 of the decoil roll 4 and/or to the pinch rolls 12 so that the feed rate will be re-established at the required value V1.

Figure 3:
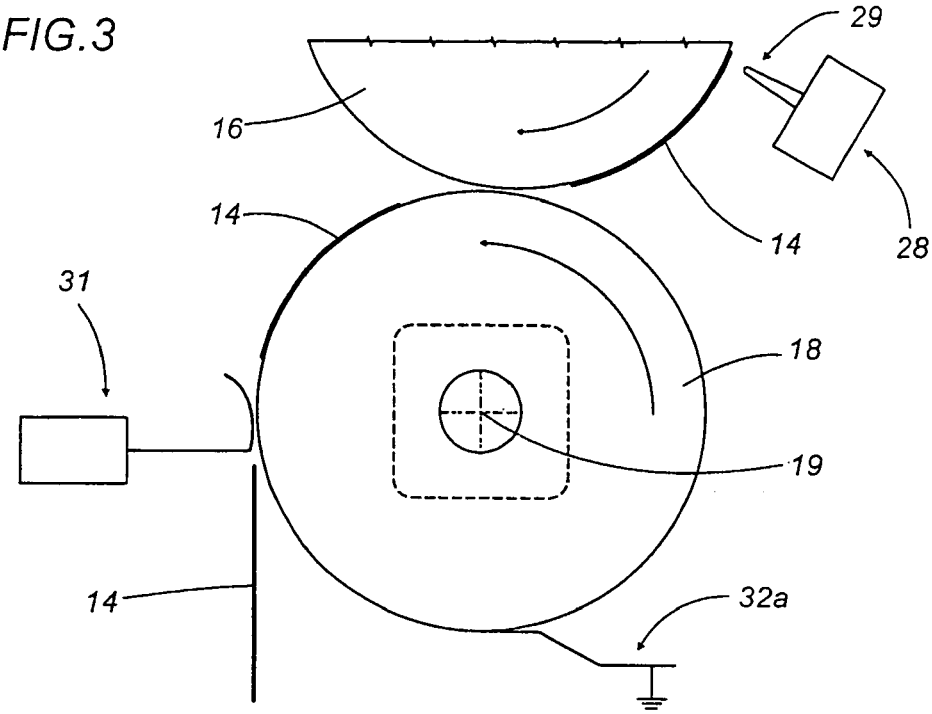
FIG. 3 illustrates a detail of the device shown in FIG. 1, in a side elevation.

Referring to the second unit 26*b* mentioned, it must be emphasized that the first roller 16 rotates on its axis 17 at a speed such as will cause the sheets 14 to be separated one from the next by a predetermined distance after being severed from the strip 9 by the cutter device 13, whilst the second roller 18 rotates at the same speed as the first roller 16. In this instance, with reference to FIGS. 1 and 3, the relative master controller 35 will again govern the timing with which the sheets 14 are charged by the emitter 29 and measure the signal received from the sensor 31, which indicates both the presence of the sheets and their position relative to the moment at which the cut occurs.

Figure 4:
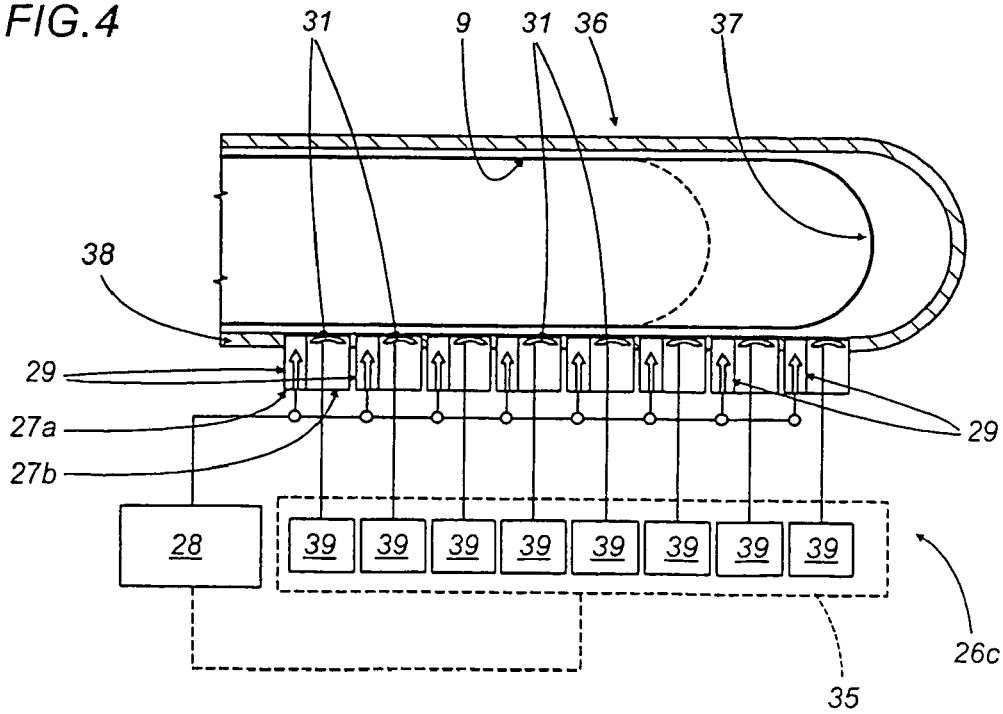
FIG. 4 illustrates a detail of the device shown in FIG. 2, in a front elevation.

In the example of FIGS. 2 and 4, the portion 1 of the packaging machine is structured in such a way that the continuous strip 9 decoiled from the respective roll 4 passes through a flow compensating chamber 36, illustrated in FIG.

4, internally of which the strip 9 forms a loop 37 expandable to a length that is variable within a predetermined range as indicated also in FIG. 2. As illustrated in FIG. 4, the wrapping material 2 is checked by a unit 26*c* positioned along one longitudinal wall 38 of the chamber 36. The checker unit 26*c* comprises a plurality of emitter devices 29 arranged in succession along the longitudinal wall 38 of the flow compensating chamber 36, each positioned to charge a predetermined portion of the running strip 9 electrostatically, and a plurality of sensors 31 capable of detecting the electrostatic charges, arranged likewise in succession along the selfsame wall 38 of the chamber 36 and in alternation with the emitter devices 29.

As in the case of FIG. 1, the emitter devices 29 arranged in succession along the longitudinal wall 38 of the flow compensating chamber 36 are positioned at respective first operative stations 27*a*, whilst the sensors 31 are positioned at respective second operative stations 27*b*.

All of the emitters 29 are coupled to a common charge generator 28 connected to the output of the master controller 35. Each sensor 31 is wired to a respective control unit 39 forming part of the master controller 35. Also, each sensor 31 is associated with a respective emitter 29 in such a way that the presence of predetermined portions of the strip 9 within the flow compensating chamber 36 can be detected moment by moment, and any variation in the length of the loop 37 running through the selfsame chamber 36 thus monitored continuously.

In the event that variations in the length of the loop 37 should drift beyond preset maximum and minimum values, within the predetermined range, the master controller 35 will relay correction signals to the drive motor 8 of the roll 4 and/or to a set of pinch rolls 40 located at a point on the feed path 3 downstream of the flow compensating chamber 36.

Likewise in this instance, the strip 9 is guided along the feed path 3 by pinch rolls 40 and guide rollers 42 that perform the same functions as the pinch rolls 12 and the guides 11 illustrated in FIG. 1, combining thus to create means, denoted 24 in their entirety, by which the wrapping material 2 is conveyed toward the user station. Here too, dischargers 32 can be associated with the conveying means 24 to perform the same function as described in connection with the embodiments of FIG. 1.

In all of the cases described thus far, the checker units 26 are designed to operate upstream of the user station 5 and, accordingly, the steps of applying and detecting the electrostatic charges are effected along the feed path 3 followed by the wrapping material.

Also illustrated in FIG. 2 is a unit 26*d* comprising an emitter 29 and a sensor 31 located downstream of the user station 5 and on the second feed path 22, along which products 21 united with the wrapping material 2 at the user station 5 are caused to advance through the agency of a belt conveyor 41 constituting the aforementioned conveying means 24. Likewise in this instance, dischargers 32 can be associated with the conveyor 41 for the purpose of eliminating any residual electrostatic charges from the conveying means 24.

Figure 5:
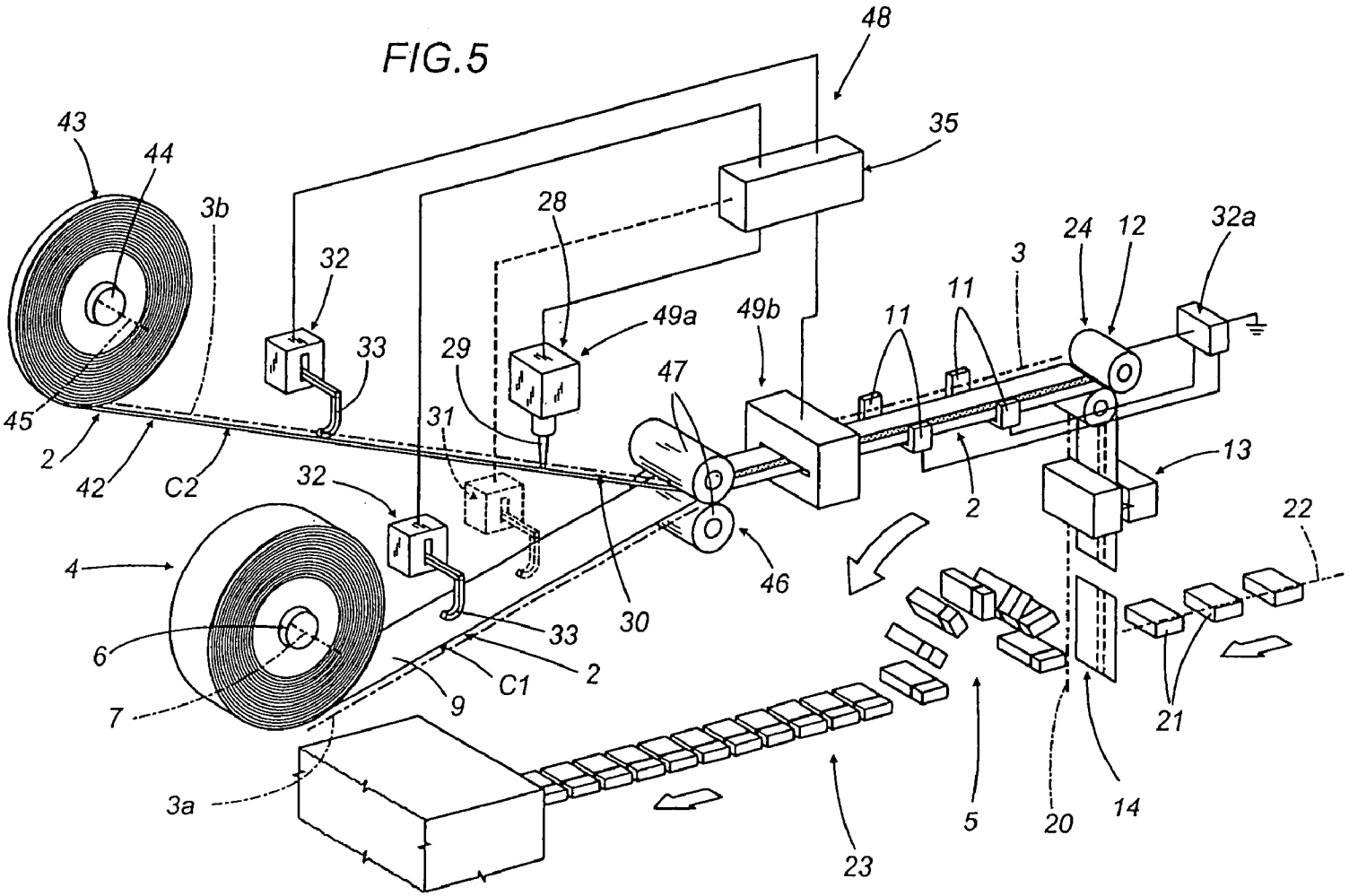
FIG. 5 illustrates a portion of a packaging machine comprising the checking device according to the present invention, shown in a further embodiment, viewed schematically and in perspective with certain parts omitted.

Referring now to FIG. 5, the wrapping material 2 comprises a first component C1 provided by the continuous strip 9 decoiled from the roll 4, and a second component C2 appearing in this particular instance as a second strip 42 exhibiting a transverse dimension less than that of the first strip 9.

The strip 42 is decoiled from a respective roll 43 mounted to a pivot 44 of which the axis 45 is disposed parallel to the axis 7 of the first roll 4, and driven by a respective motor (not illustrated) such as will cause the strip 42 to decoil at the same rate as the first strip 9.

Advancing along respective feed paths denoted 3*a* and 3*b*, the strips 9 and 42 converge on a bonding station 46 at the start of the first feed path 3, which in this embodiment becomes a common path followed by the two components C1 and C2 bonded one to another.

The station 46 comprises a pair of contrarotating rollers 47, disposed substantially tangential one to another with axes lying parallel to the axes 7 and 45 of the decoil rolls 4 and 43, and marking the start of the common feed path 3.

In like manner to the embodiment illustrated in FIG. 1 and described previously, the wrapping material 2 composed of the two strips 9 and 42 is directed and advanced toward the cutter device 13 through the agency of the guides 11 and the pinch rolls 12, respectively, and divided into sheets 14.

The sheets 14 are conveyed one by one to the user station 5 where, as already described in referring to the embodiment of FIG. 1, they will be intercepted cyclically by the products 21 advancing along the second feed path 22 and conveyed together with the products along the wrapping line 23. Again, the pinch rolls 12 and the guides 11 can be furnished with earth contacts 32*a*.

As illustrated in FIG. 5, the legs 3*a*, 3*b* and 3 of the first feed path extending between the decoil rolls 4 and 43 and the pinch rolls 12 are occupied by a unit 48 for checking the wrapping material 2 that comprises, located on the leg 3*a* of the one strip 9, a discharger 32 with a relative sliding contact 33, and on the leg 3*b* of the other strip 42, proceeding from upstream downwards in the feed direction, a discharger 32 with a relative sliding contact 33 and, coinciding with a first operative station 49*a*, an electrostatic charge generator 28 with a respective emitter device 29 positioned to invest predetermined portions 30 of the strip 42 with electrostatic charges.

Figure 8:
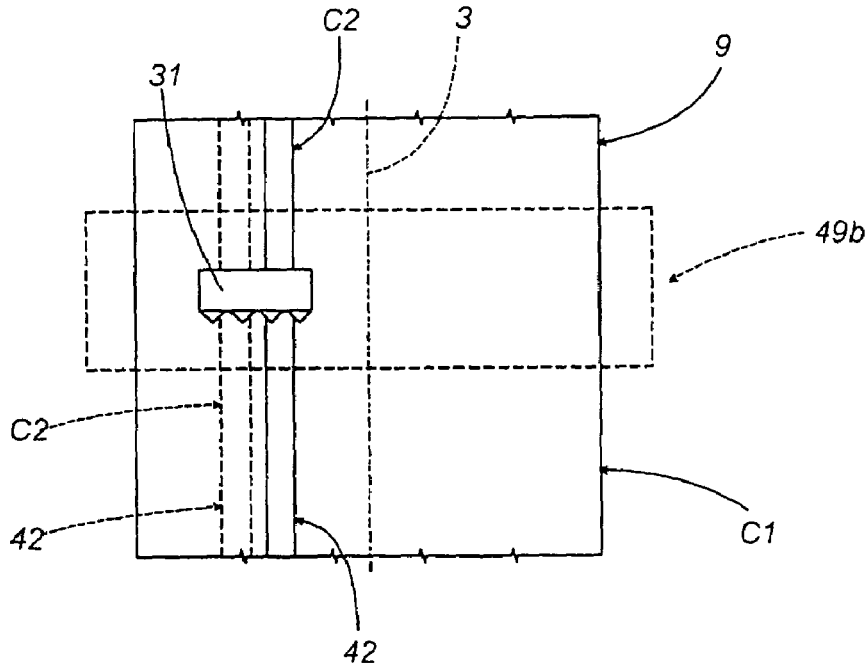
FIGS. 8 and 9 illustrate an enlarged detail of FIG. 5 in two different embodiments, viewed in plan.
Figure 9:
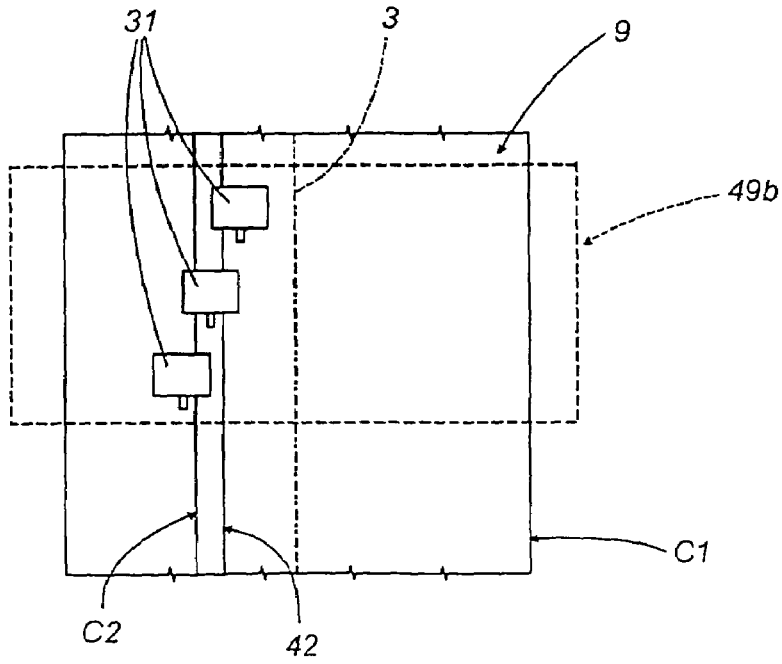

Downstream of the bonding station 46, the checker unit 48 comprises a second operative station 49*b* equipped, as shown in FIGS. 8 and 9, with one or more sensors 31 placed to detect the electrostatic charges applied at the first station 49*a*.

In a second embodiment illustrated with phantom lines in FIG. 5, the checker unit comprises a further sensor 31, positioned along the leg 3*a* of the wider strip 9 at a point between the discharger 32 and the bonding station 46, serving to detect any electrostatic charges present on this same strip 9.

As in the examples of FIG. 1, the checker unit 48 comprises a master controller 35 to which all of the various electrical and electronic components making up the unit are wired.

Figure 6:
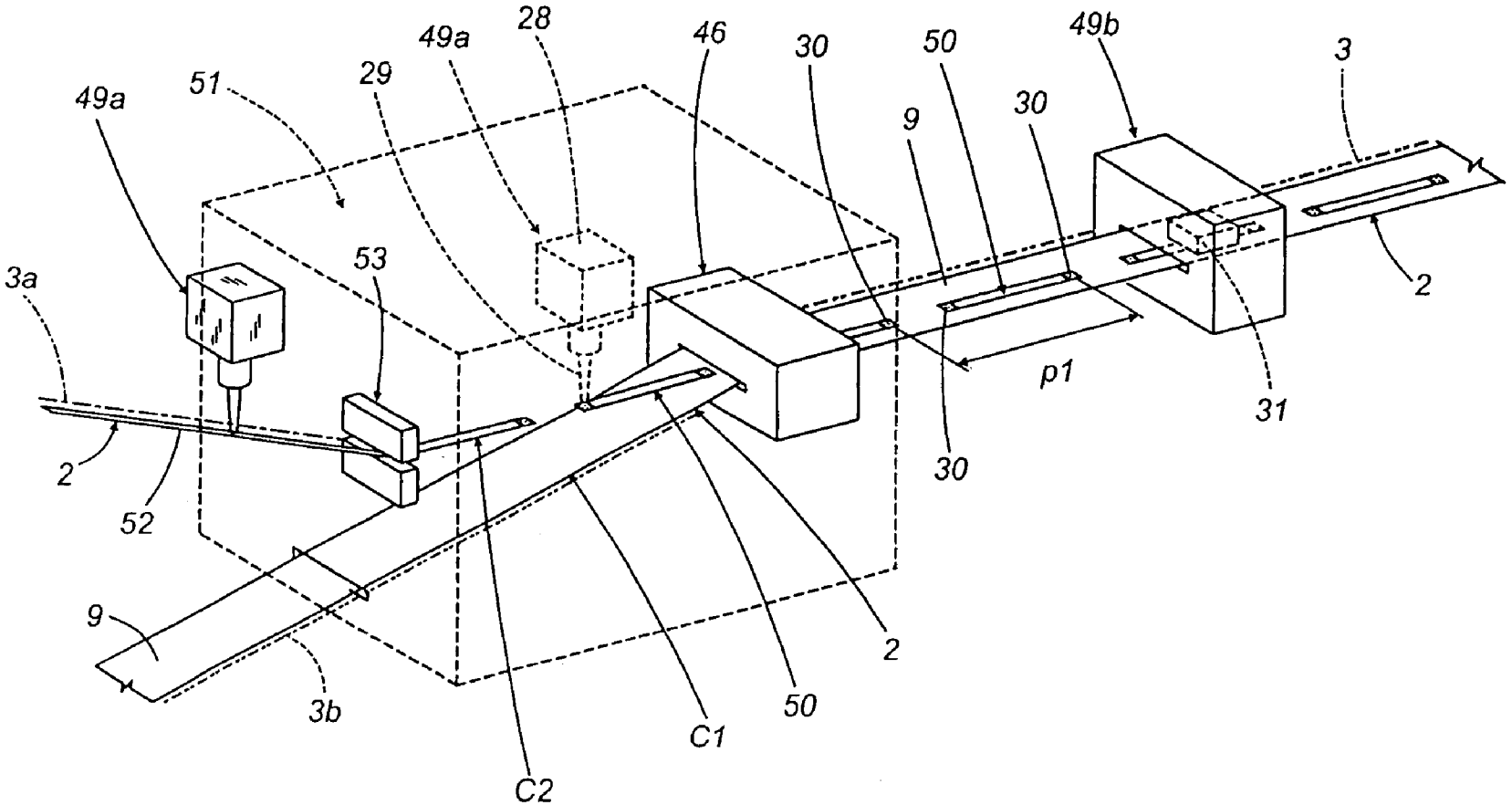
FIGS. 6 and 7 illustrate an enlarged detail of FIG. 5 in two different embodiments, viewed schematically and in perspective.
Figure 7:
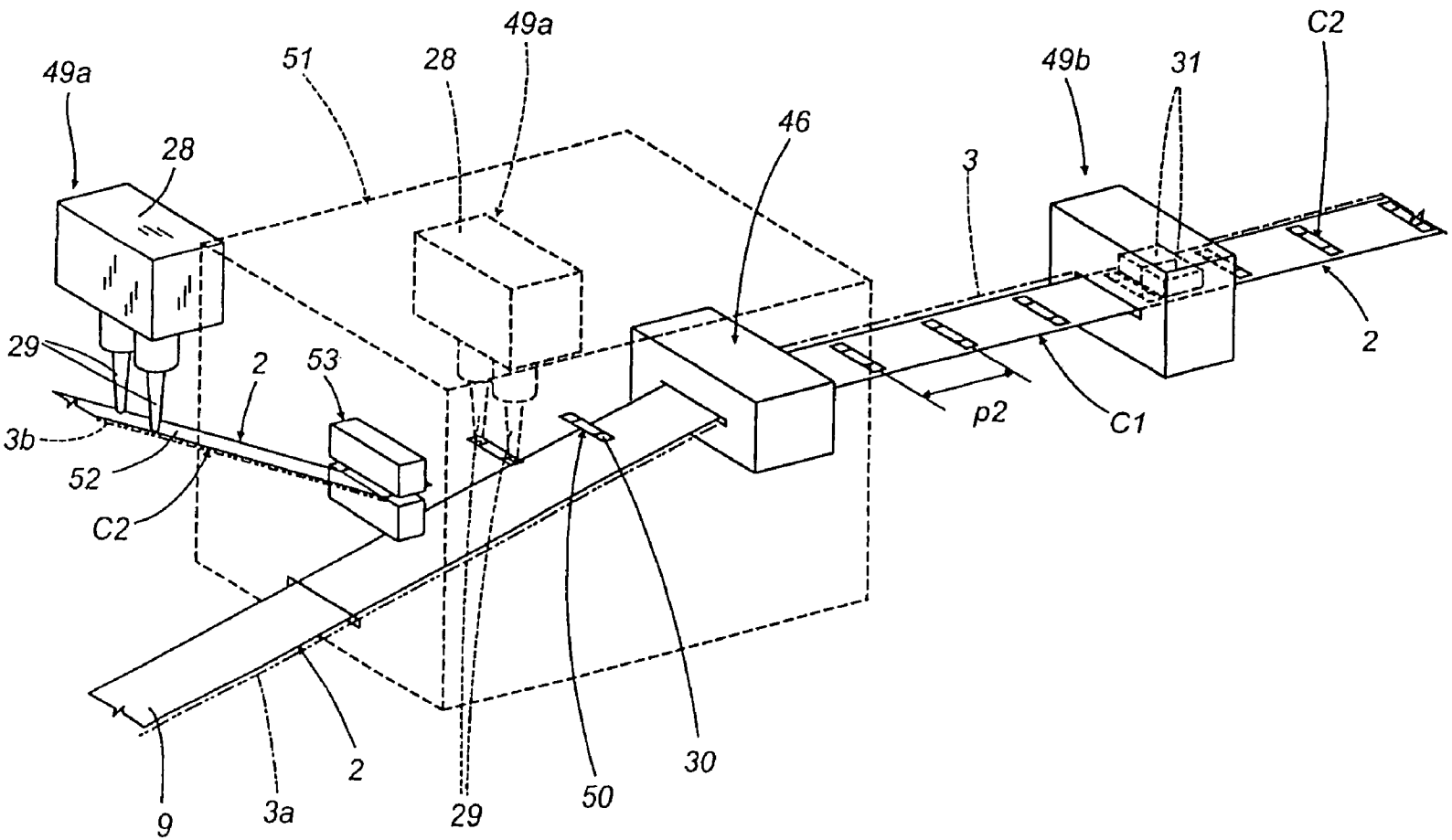

With reference to FIGS. 6 and 7, the wrapping material 2 directed toward the cutter device 13 is no longer composed of two continuous strips bonded together, but rather of one continuous strip 9 as the first component C1 of the material and a succession of discrete lengths or slips 50 as the second component C2 of the material, with the strip 9 functioning as the support component.

The slips 50 are cut and fixed to the strip 9 by a relative device of conventional type, indicated schematically by a block denoted 51, into which the first strip 9 is directed together with a second continuous strip 52, the latter passing through a respective cutter device 53.

More precisely, the strip 52 in the example of FIG. 6 is a continuous strip presenting the same transverse dimensions as the strip 42 of FIG. 5, and the slips 50 are applied to the strip 9 oriented parallel to the common feed path 3 followed by the wrapping material 2, maintaining a predetermined placement and a first longitudinal pitch denoted p1. In this instance the generator 28 and the corresponding emitter 29 can be positioned upstream of the cutter device 53 in such a way as to charge successive portions 30 of the continuous strip 52 destined to coincide substantially with the two ends of each slip 50 following the cutting operation. Alternatively, the generator 28 and the corresponding emitter 29 can be placed, as shown by the phantom lines, immediately downstream of the cutter device 53 and preceding the point at which the slips 50 are applied to the strip 9 at the bonding station 46, indicated schematically by a block, likewise in such a way as to charge the portions 30 coinciding with the ends of each slip 50.

In the example of FIG. 7, the strip 52 is a continuous strip of which the transverse dimension is broadly similar to that of the first strip 9, and the slips 50 are generated by a cutter device 53 set up so as divide the strip 52 into slivers, each constituting one slip 50.

Thereafter, the slips 50 are applied to the strip 9 at the bonding station 46, oriented transversely to the common feed path 3 followed by the wrapping material 3, maintaining a predetermined placement and a second longitudinal pitch denoted p2.

In this instance, given the transverse orientation of the slips 50, the unit will need to incorporate two generators 28 with corresponding emitters 29 to enable the simultaneous application of electrostatic charges to the portions 30 coinciding with the ends of each slip 50.

Likewise in this embodiment, the two generators 28 can be placed upstream of the cutter device 53, aligned with the two opposite edges of the strip 52, or immediately downstream of the cutter device 53, as shown by the phantom lines, preceding the point at which the slips 50 are applied to the strip 9 and acting on the two ends of each sliver.

In the example of FIG. 6, the sensor 31 placed at the second operative checking station 49*b* will be able, having successfully or unsuccessfully detected the charges applied previously at the first operative station 49*a*, to indicate the presence, the position, the timing and the orientation of the slips 50.

In the example of FIG. 7, the second operative checking station 49*b* is equipped with two sensors 31 which, having successfully or unsuccessfully detected the charges applied previously at the first operative station 49*a*, will be able to indicate the presence, the position, the timing and the orientation of the slips 50.

To obtain a high level of reliability from the checker device, referring to FIG. 5, the additional sensor 31 placed to detect the electrostatic charges, indicated by phantom lines, can be set up to provide a differential type of control in combination with the second operative station 49*b*, to the end of avoiding any interference that may occur at this same station 49*b* due to the presence of residual charges on the strip 9; this method can also be adopted in the examples of FIGS. 6 and 7.

In other words, the master controller 35 is able to take account of any residual charges in the strip 9 that may be detected by the sensor 31 placed along the first leg 3*a* of the feed path.

Moreover, and again to the end of maximizing the reliability of the checker device, the generator 28 is able, through the agency of the corresponding emitter 29, to charge the predetermined portions 30 in pulsed mode at a selected frequency.

To this end, the corresponding sensor 31 will be set up to detect and recognize the impulsive charges applied previously, thereby avoiding any interference that might otherwise be occasioned by residual charges on the strip 9.

As discernible from FIGS. 8 and 9, the sensors 31 can be installed in any convenient number, aligned transversely across or staggered along the common feed path 3. More exactly, these configurations will allow the checker unit to detect the presence and/or position of the strip 42 or the slips 50 within a band of predetermined width. Should it become evident from the detection step that the one strip 42 is advancing in an incorrect position relative to the other strip 9, the sensors will relay a control signal to a device of familiar type (not illustrated) capable of correcting the position of the decoiling strip 42, for example by shifting the roll 43 along its axis 45 of rotation.

Finally, it should be emphasized that the invention is by no means limited to the particular types of embodiment described above and illustrated in the accompanying drawings, but embraces all methods and devices designed to check the presence and/or rate of feed and/or timing of wrapping materials by "marking" the selfsame materials with electrostatic charges.

This type of marking is particularly advantageous for transparent wrapping materials, such as clear polypropylene, given that after the checking step has been effected, the mark can be removed simply by eliminating the charge from the wrapping material.

What is claimed is:

1. A method for checking wrapping material in a packaging machine comprising the steps of:

supplying a wrapping material to a packaging machine;

using an electrostatic charge emitter to electrostatically charge at least one predetermined portion of the wrapping material at a first operative station; and detecting the presence of electrostatic charges on the predetermined portion of the wrapping material at a second operative station; and discharging the electrostatic charges from the wrapping material;

enveloping nredetermined oroducts in the wrappjng material at a user station;

the steps of applying and detecting the electrostatic charges being effected along a feed oath upstream of the user station on a continuous strip of the wrapping material advancing along the feed path which extends through a flow compensating chamber and forms a loop of length variable within a predetermined range, the steps of applying and detecting the electrostatip charges being effected along the predetermined range governing the length of the loop and utilized to vary a length of the loop.

2. A method as in claim 1, wherein the step of ridding the wrapping material of leaked electrostatic charges prevents the wrapping material from possible leakages of the electrostatic charges on the predetermined portion of the material.

3. A method as in claim 1, wherein the wrapping material comprises at least a first and a second wrapping component and the steps of applying and detecting the electrostatic charges are effected on at least one of the two wrapping components.

4. A method as in claim 3, wherein the two wrapping components comprise two continuous strips of wrapping material, the method further comprising a step of bonding the two strips one to another in predetermined mutual positions.

5. A method as in claim 4, wherein at least the detecting step occurs following the step of bonding the two wrapping components one to another.

6. A method as in claim 5, wherein the detecting step serves to verify the pitch at which the discrete lengths are distanced one from the next.

7. A method as in claim 4, wherein the two strips present dissimilar transverse dimensions.

8. A method as in claim 4, wherein the step of applying the electrostatic charges is effected in pulsed mode at a predetermined frequency.

9. A method as in claim 8, wherein the first component comprises a continuous strip of wrapping material and the second component comprises a succession of discrete lengths of wrapping material bonded to the continuous strip at a predetermined pitch and in a predetermined position.

10. A method as in claim 9, wherein the discrete lengths of wrapping material present a transverse dimension smaller than that of the continuous strip.

11. A method as in claim 10, wherein the discrete lengths of wrapping material are bonded to the continuous strip oriented parallel to the predetermined feed path followed by the wrapping material.

12. A method as in claim 11, wherein electrostatic charges are applied to at least two distinct portions of each discrete length of wrapping material.

13. A method as in claim 12, wherein the detecting step serves to verify the pitch and the orientation of the discrete lengths.

14. A method as in claim 10, wherein the discrete lengths of wrapping material are bonded to the continuous strip oriented transversely to the predetermined feed path followed by the wrapping material.

15. A method as in claim 1, wherein the detecting step serves to verify the presence of the charged component.

16. A method as in claim 1, wherein the steps of applying and detecting the electrostatic charges are effected on discrete lengths of wrapping material defined by cutting a continuous material and advanced along the predetermined feed path.

17. A method as in claim 1, comprising a plurality of steps of applying electrostatic charges and a plurality of steps of detecting electrostatic charges effected in alternation along the predetermined range within which the length of the loop is variable.

18. A method as in claim 1, wherein the wrapping material is united with predetermined products at a user station, and the steps of applying and detecting the electrostatic charges are effected downstream of the user station.

19. A method as in claim 18, wherein the products are supplied to the packaging machine along a second predetermined feed path and united with the wrapping material, and the steps of applying and detecting the electrostatic charges are effected along the second predetermined path.

20. A method as in claim 1, wherein the wrapping material is caused to advance by respective conveying means, and further comprising at least one step of eliminating electrostatic charges from the conveying means.

21. A method for checking wrapping material in a packaging machine comprising the steps of:

supplying a continuous strip of wrapping material to a packaging machine along a feed path upstream of a user station enveloping predetermined products in the wrapping material itself, the continuous strip being supplied through a flow compensating chamber forming a loop expandable to length according to a variable and predetermined range;

checking the wrapping material along at least one longitudinal wall of the flow compensating chamber by a plurality of emitter devices and detecting sensors arranged in succession along the longitudinal wall of the flow compensating chamber, each emitter device charging a predetermined portion of the loop of the continuous strip electrostatically and each detecting sensor detecting the electrostatic charges;

electrostatically charging the predetermined portions via use of the emitter devices;

detecting said electrostatic charges via use of the detecting sensors;

monitoring continuously any variation in the length of the loop by means of the detecting sensors;

comparing any variation in the length of the loop monitored with preset maximum and minimum values;

correcting the length of the loop when the variation in length drifts beyond the preset maximum or minimum value.

22. A device for checking wrapping material in a packaging machine, wherein the wrapping material is supplied to the packaging machine, comprising;

electrostatic charge emitter means to charge at least one predetermined portion of the wrapping material electrostatically at a first operative station, sensing means to detect the presence of electrostatic charges in the predetermined portion of the wrapping material at a second operative station, and discharger means positioned downstream of the emitter means and the sensing means and serving to eliminate the electrostatic charges from the wrapping material;

a flow compensating chamber through which the wrapping material is advanced along a feed oath and caused to form a loop of lenath variable within a predetermined range, wherein the emitter means comprise a plurality of emitter devices ordered along the flow-compensating chamber and the sensing means comprise a plurality of sensors able to detect electrostatic charges. ordered likewise along the flow-compensating chamber and alternated with the emitter devices In such a way as to monitor the variation in length of the loop internally of the chamber;

a controller acting to control the length of the loop and maintain such length in the predetermined range in response to the monitoring of the variation in length of the loop.

23. A device as in claim 22 for checking a wrapping material comprising at least one wrapping component in the form of a continuous strip advanced along a respective feed path, wherein the emitter means are positioned along the feed path and the sensing means are positioned along the selfsame feed path downstream of and at a predetermined distance from the emitter means in such a way as to detect a velocity of the advancing strip.

24. A device as in claim 23, for checking a wrapping material comprising a first and a second wrapping component, wherein the emitter means and the sensing means are positioned along the feed path followed by at least one of the two wrapping components.

25. A device as in claim 24, wherein the two wrapping components comprise two continuous strips of wrapping material, the device comprising a station at which the two strips are bonded one to another in predetermined mutual positions.

26. A device as in claim 25, wherein at least the sensing means are positioned downstream of the station at which the two wrapping components are bonded one to another.

27. A device as in claim 26, wherein the sensing means comprise means capable of verifying the pitch at which the discrete lengths are distanced one from the next.

28. A device as in claim 25, wherein the two strips present dissimilar transverse dimensions.

29. A device as in claim 25, wherein the emitter means comprise an emitter delivering pulsed electrostatic charges at a predetermined frequency.

30. A device as in claim 28, wherein the first component comprises a continuous strip of wrapping material and the second component comprises a succession of discrete lengths of wrapping material bonded to the continuous strip at a predetermined pitch and in a predetermined position.

31. A device as in claim 25, wherein the discrete lengths of wrapping material present a transverse dimension smaller than that of the continuous strip.

32. A device as in claim 30, wherein the discrete lengths of wrapping material are bonded to the continuous strip oriented parallel to the predetermined feed path followed by the wrapping material.

33. A device as in claim 32, wherein the emitter means are embodied in such a way as to charge at least two distinct portions of each discrete length of wrapping material.

34. A device as in claim 33, wherein the sensing means comprise means capable of verifying the pitch and the orientation of the discrete lengths.

35. A device as in claim 30, wherein the discrete lengths of wrapping material are bonded to the continuous strip oriented transversely to the predetermined feed path followed by the wrapping material.

36. A device as in claim 22, wherein the sensing means comprise means capable of verifying the presence of the charged component.

37. A device as in claim 22, for checking wrapping material supplied in the form of discrete lengths generated by cutting the selfsame material, wherein the emitter means are positioned along the predetermined path and the sensing means are positioned along the selfsame path downstream of and at a predetermined distance from the emitter means in such a way as to detect the presence and/or the timing of the discrete lengths of wrapping material.

38. A device as in claim 22, for checking wrapping material destined to be united with predetermined products at a user station, whereupon the products and the material are advanced along a second predetermined feed path, wherein the emitter means and the sensing means are positioned along the second predetermined path in such a way as to verify at least one of presence, velocity or timing of the products.

39. A device as in claim 22, wherein the wrapping material is caused to advance by respective conveying means, the device further comprising discharger means serving to eliminate electrostatic charges accumulated on the conveying means.

* * * * *